United States Patent [19]

Hooper

[11] 3,938,307

[45] Feb. 17, 1976

[54] DRAWING AND TEXTURING BY FALSE TWIST CRIMPING OF SYNTHETIC TEXTILE FILAMENT

[75] Inventor: Norbert Hooper, Castleton near Rochdale, England

[73] Assignee: Platt International Limited, Lancashire, England

[22] Filed: Mar. 28, 1974

[21] Appl. No.: 455,876

[30] Foreign Application Priority Data

Apr. 2, 1973 United Kingdom ..... 15697/73

[52] U.S. Cl. ..... 57/34 HS; 57/157 TS

[51] Int. Cl.[2] D01H 13/02; D02G 1/02; D01H 13/28

[58] Field of Search... 57/34 R, 34 HS, 55.5, 157 R, 57/157 TS, 36

[56] References Cited

UNITED STATES PATENTS

| | | | |
|---|---|---|---|
| 3,018,608 | 1/1962 | Kleekamm et al. | 57/55.5 X |
| 3,159,964 | 12/1964 | Kretsch | 57/55.5 X |
| 3,474,612 | 10/1969 | Jenkins et al. | 57/34 HS |
| 3,535,866 | 10/1970 | Tsuruta et al. | 57/34 HS |
| 3,589,120 | 6/1971 | Phillips | 57/55.5 X |
| 3,724,191 | 4/1973 | Hooper | 57/34 HS |
| 3,793,817 | 2/1974 | Beringer et al. | 57/34 HS |
| 3,828,537 | 8/1974 | Doschko | 57/34 HS |

*Primary Examiner*—Donald E. Watkins
*Attorney, Agent, or Firm*—Watson, Cole, Grindle & Watson

[57] ABSTRACT

A false-twist texturing method and apparatus wherein synthetic filaments are drawn in a draw zone, passed from said draw zone to feed means for feeding the drawn yarn at a speed lower than the speed in the draw zone to a texturing zone wherein the yarn is texturized.

8 Claims, 2 Drawing Figures

DRAWING AND TEXTURING BY FALSE TWIST CRIMPING OF SYNTHETIC TEXTILE FILAMENT

Figure 1:
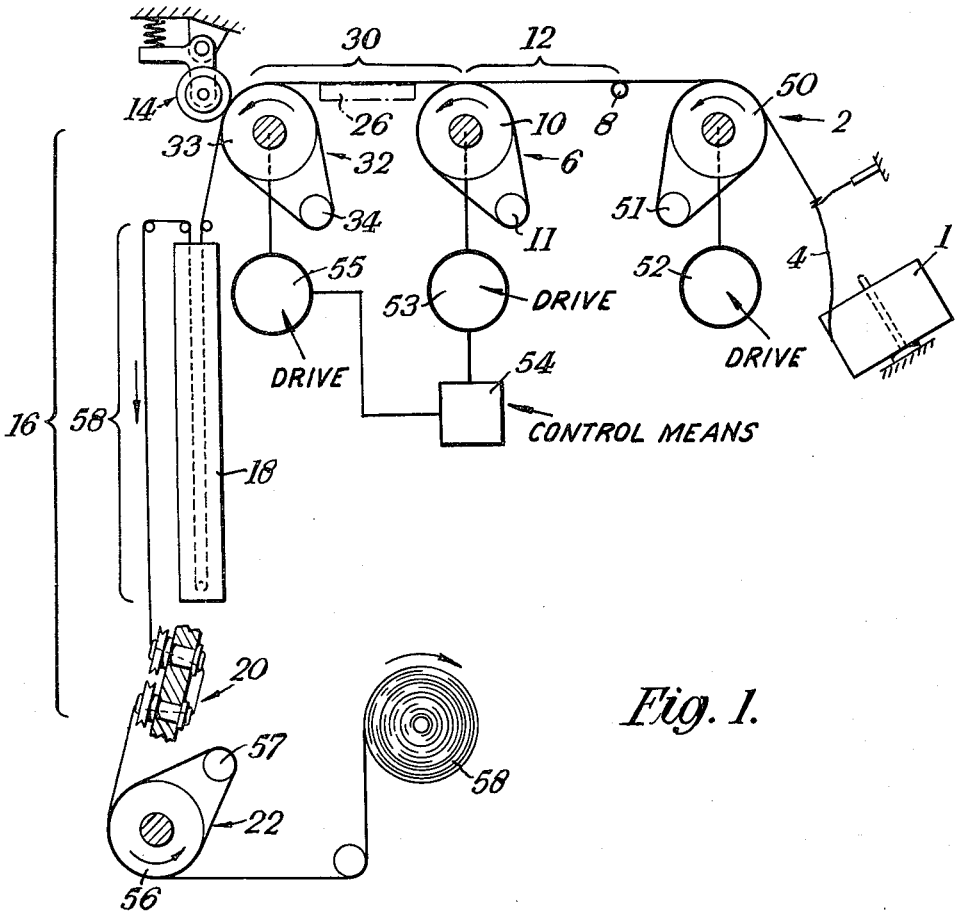

The present invention relates to apparatus for drawing and texturing by false twist crimping synthetic textile filament yarn in a continuous operation.

In an apparatus hitherto proposed for drawing and texturing synthetic filament yarn, a yarn passes successively through a draw zone and a texturing zone. The yarn is fed by a feed roller means to the draw zone where it is subjected to drawing. The drawn yarn is advanced from the draw zone by a second feed roller means to the texturing zone where it is first softened in a heating zone, cooled in a cooling zone and then false twisted by a false twist device, the false twist running back in the yarn through the cooling zone to the heating zone. From the false twist device, the yarn is delivered to a further feed roll means located down-stream of the false twist device. The second feed roller means defines the end of the draw zone and the start of the texturing zone, while the end of the texturing zone is defined by the further feed roller means. It is common to drive the second feed roller means assembly at a speed up to five times the surface speed of the first feed roller means to draw the yarn in the draw zone by a ratio of up to 5:1.

The yarn in the draw zone is under dynamic tension, that is, any variation in the tension of the yarn in the draw zone causes a similar variation in the tension in the yarn downstream thereof. It will be appreciated therefore that the close control of the parameters of the yarn processing which are strongly dependent upon tension is very difficult in that any change in the tension in the draw zone affects the tension in the texturing zone. This requires a re-setting of the texturing parameters and may in some cases prevent texturing at optimum conditions. This problem does not arise in texturing processes wherein no dynamic tension is set up in the system for example, in stuffer box crimping wherein the tension downstream of input rollers to the stuffer box is zero and hence the tension upstream of the rollers is unimportant in controlling the texturing parameters.

Furthermore, the communication of yarn from the draw zone directly to the texturing zone in the conventional apparatus allows no close control of the crystalline state of the filaments before being fed to the texturing zone. It is known that yarn immediately following drawings has an inherent tendency to contract by of the order of 10 percent. Contraction of the yarn, if allowed, alters the crystalline state of the filaments and further alteration can be effected by applying heat to the yarn following drawing. In the above conventional apparatus, no provision is made for controlling the crystalline state of the filaments and all variations of the crystalline state take place in the texturing zone only under the control of the texturing parameters. It has been found that unless the crystallinity of the yarn is controlled before entry of the yarn to the texturing zone the quality of the finished yarn may be unacceptable.

At high yarn speeds, of the order of 750 meters per minute, control of the texturing parameters needs to be very exact to ensure processing at the optimum conditions. The stability of the yarn, the number of turns of twist inserted and the tension in the yarn are closely related and at such higher speeds are very dependent upon the rates of feed of second feed roller means and the further feed roll means. Thus, in such apparatus it is very difficult to accurately control the texturing parameters and in some cases it is impossible to process acceptable yarns at the higher speeds in view of the lack of accurate control.

It is accordingly a primary object of the invention to provide a method of and an apparatus for drawing and texturing by false twist crimping a synthetic filament yarn in a continuous operation wherein the tension of yarn fed to the texturing zone can be controlled.

According to a first aspect of the invention, there is provided a process for drawing and texturing by false twist crimping a synthetic filament yarn, comprising the steps of drawing the yarn in a drawing zone, allowing the drawn yarn to at least partially contract in a contraction zone, feeding the contracted yarn from the contraction zone to a false twist texturing zone and then false twist texturing the yarn in said texturing zone.

According to a second aspect of the invention, there is provided an apparatus for drawing and texturing by false twist crimping a synthetic filament, comprising draw means for drawing the yarn, yarn contraction means for allowing the drawn yarn to at least partially contract, and false twist texturing means for receiving yarn fed thereto from the yarn contraction means and including heating means for heating the yarn, followed by a cooling zone and false twist crimping means for inserting false twist into the yarn which runs back along the yarn through the cooling zone to the heating means.

According to a third aspect of the invention there is provided an apparatus for drawing and texturing by false twist crimping a synthetic filament, comprising draw means including first feed roller means for forwarding yarn from a yarn supply at a first speed and second feed roller means for receiving yarn from the first feed roller means at a second speed greater than the first speed to effect drawing of the yarn, yarn contraction means for allowing the drawn yarn to at least partially contract and including third feed roller means downstream of the second feed roller means for receiving yarn therefrom and for forwarding the yarn to a texturing zone including yarn heating means, a cooling zone wherein the heated yarn is cooled and a false twist crimping device for inserting false twist in the yarn to run back through the cooling zone to the heating means, and fourth feed roller means for withdrawing yarn from the texturing zone.

Figure 2:
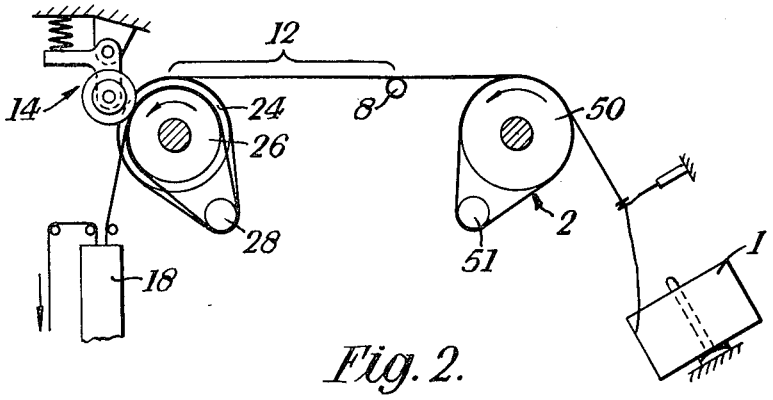

Three embodiments of the invention will now be described, by way of example, with reference to the accompanying drawings in which:

FIG. 1 is a diagrammatic side elevation of a first embodiment of a draw-texturing apparatus according to the invention, and FIG. 2 is a diagrammatic side elevation of a second embodiment of a draw-texturing apparatus.

Referring firstly to FIG. 1, a draw-texturing apparatus includes a first feed roller means comprising a first roller 50 and a first separator roll 51. The first roller is driven by drive means 52. Adjacent the first feed roller means is a second feed roller means 6 with a snubbing pin 8 therebetween. The zone between the snubbing pin 8 and the second feed roller means comprises a draw zone 12. The second feed roller means 6 includes a draw roller 10 and a separator roll 11. The draw roller 10 is driven by drive means 53 whose speed can be controlled by a control device 54. A third feed roller means 32 is positioned downstream of the second feed roller means 6 and provides, with the second feed roller means 6, a contraction zone 30. The third feed roller means 32 includes a feed roller 33 and a separator roll 34 and a spring loaded cott roller 14. The feed roller 33 is driven by drive means 55 whose speed can be controlled by the control device 54.

A texturing zone 16 follows the contraction zone 30 and includes a heater 18 and a twin bush false twist crimping device 20, with a cooling zone 58 therebetween. A fourth feed roller means 22 follows the texturing zone 16 and comprises a roller 56 and a co-operating separator roll 57.

In use, a nylon multifilament yarn 4 is drawn from a package 1 or from a yarn spinning head (not shown) and passes around the first roller 50 and the separator roll 51. The yarn 4 then takes one turn around the snubbing pin 8. The draw roller 10 is driven at a speed greater than that of the first roller 50 and so the yarn 4 is drawn in the draw zone 12. The drawn yarn 4 then passes to the draw roller 33 and separator roll 34 which are driven at a slower speed than the draw roller 10 of the second feed roller means 6. Thus the yarn is allowed to contract or relax in this contraction zone 30 by an amount dependent on the relative speeds of the rollers 10, 33.

The contracted yarn 4 is then heated as it passes over the surface of the heater 18 before reaching the twin bush false twist crimping device 20. This inserts false twist which runs back along the yarn 4 through the cooling zone 58 and across the surface of the heater 18. The twist is halted by the spring loaded cott roller 14 which nips the last wrap of the yarn 4 around the draw roller 33.

It is essential that the tension between the third and fourth feed roller means 32, 22 is carefully controlled to ensure false twisting of the yarn at the optimum conditions. Normally, therefore, with other conditions in the texturing zone kept constant, the tension in the zone must lie within a certain predetermined range.

In draw-texturing apparatus in which the third feed roller means 32 are omitted and the yarn 4 passes directly from the second feed roller means 6 to the texturing zone 16, if the draw zone tension is raised from, for example, 150 grams to 170 grams, the maximum tension in the texturing zone 16 may rise from an optimum 100 grams to an unacceptable 113 grams.

In the apparatus described above with reference to the drawings, if the draw zone tension is raised from, for example, 150 grams to 170 grams, the tension in the contraction zone 30 is raised from, for example 100 grams to 113 grams with a consequent rise in the maximum tension in the texturing zone 16. However, by varying the amount of overfeed between the second and third feed roller means 6, 32 by the control device 54, the tension in the zone 30 can be reduced again to 100 grams thus retaining the tension in the texturing zone 16 at the previous optimum level.

Furthermore, the fact that the tension in the contraction zone 30 can be maintained lower than the draw tension, allows a relaxation or contraction of the yarn 4 to effect the crystallinity thereof. The contraction may be up to 15 percent depending upon the type of yarn involved and is preferably between 5 and 10 percent.

Thus the tension in the yarn 4 and the crystallinity of the filaments of the yarn can be carefully controlled before entry to the texturing zone 16.

In order to affect crystallinity to a greater degree, a heater 26 shown in broken lines in FIG. 1 is, in a second embodiment, provided between the second and third feed roller means 6, 32 to effect heating of the yarn 4 in the contraction zone 30. The heater 26 is arranged so that the yarn 4 passes over a heated surface thereof to heat-set the yarn before entry to the texturing zone 16. In an alternative embodiment (not shown), the heater 26 is omitted and the roller 10 is heated to effect heating of the yarn in the zone 30.

Referring now to FIG. 2, a third embodiment will now be described, parts common to FIGS. 1 and 2 are given the same reference numerals and will not be described in detail. The second and third feed roller means comprise a larger diameter draw roller 24 coaxial with a smaller diameter draw roller 26. A common separator roll 28 is provided and the rollers 24, 26 are driven together. The yarn 4 is drawn between the snubbing pin 8 and the larger diameter draw roller 24. After passing three times around the larger diameter draw roller 24 and a first part of the separator roll 28, the yarn passes round the smaller diameter draw roller 26 and the other part of the separator roller 26. The larger diameter is of the order of 10 percent less than the smaller diameter with the result that, as they rotate together, the surface speed of the larger diameter draw roller 26 is 10 percent than that of the smaller diameter draw roller 24. This provides a constant overfeed between the two portions of 10 percent allowing contraction of the yarn and hence an alteration in the crystalline state of the filaments. Thus the tension in the texturing zone 16 can be controlled accurately because the crystalline state of the filaments is more accurately controlled before entry to the texturing zone 16.

I claim:

1. In a process for drawing and texturing a synthetic filament yarn by false twist crimping comprising, drawing yarn from a yarn supply in a draw zone between first feed roller means and second feed roller means with the second feed roller means forwarding the yarn at a speed greater than the forwarding speed of the first feed roller means to effect said drawing, texturing the drawn yarn in a false twist texturing zone by heating the yarn, passing the heated yarn through a cooling zone and then false twist texturing the yarn by inserting false twist into the yarn which runs back through the cooling zone to be heated and then withdrawing the yarn from the texturing zone, the improvement comprising engaging and positively driving the yarn after the second feed roller means with a third feed roller means forwarding the yarn from the third feed roller means to the texturing zone at a speed less than the forwarding speed of the second feed roller means to allow the yarn to contract between the second and third feed roller means thus controlling the tension of the yarn received by the texturing zone.

2. A process according to claim 1 and comprising heating the yarn during said contraction step.

3. In an apparatus for drawing and texturing by false twist crimping a synthetic filament yarn comprising first feed roller means for forwarding yarn from a yarn supply at a first speed to a draw zone, second feed roller means for withdrawing yarn from the draw zone at a second speed greater than the first speed to effect drawing of the yarn in the draw zone, texturing means for receiving the drawn yarn and including yarn heating means for heating the yarn, a cooling zone in which the heated yarn is cooled and a false twist crimping means for inserting false twist into the yarn to run back through the cooling zone to the heating means and withdraw feed roller means for withdrawing yarn from the texturing zone, the improvement comprising third feed roller means for receiving yarn from said second feed roller means and for engaging and positively driving the yarn at the rate of rotation of the said third feed roller means to feed the yarn to said texturing means at a speed less than the speed of said second feed roller means to allow the yarn to contract between the second and third feed roller means whereby the tension of the drawn yarn received by the texturing means is controlled.

4. Apparatus according to claim 3 wherein the third roller feed means are spaced from the second feed roller means, wherein the second feed roller means are driven at a faster rate than the third feed roller means to permit the yarn to contract therebetween and wherein the second and third feed roller means have control means associated therewith whereby the relative speed between the second and third feed roller means may be adjusted.

5. Apparatus according to claim 4 wherein the a heater is arranged between the second feed roller means and the third feed roller means, the heater acting on said yarn in its path between the second feed roller means and the third feed roller means.

6. Apparatus according to claim 3 wherein the second and third feed roller means are arranged co-axially, the yarn contacting the second feed roller means before contacting the third feed roller means and the second feed roller means forwarding the yarn at a faster rate than the third feed roller means to permit the yarn to contract therebetween.

7. Apparatus according to claim 6 wherein the second and third feed roller means comprise co-axial second and third rollers mounted for rotation together, the second roller being of greater diameter than the third roller.

8. Apparatus according to claim 7 wherein the second and third rollers have a single separator roller associated therewith, the yarn passing around the second roller and a part of the separator roller before passing around the third roller and another part of the separator roller.

* * * * *